US010773299B2

(12) United States Patent
Feigenblum

(10) Patent No.: US 10,773,299 B2
(45) Date of Patent: Sep. 15, 2020

(54) METHOD AND DEVICE FOR CASTING A METAL ALLOY

(71) Applicant: ROCTOOL, Le Bourget du Lac (FR)

(72) Inventor: José Feigenblum, Saint Paul (FR)

(73) Assignee: ROCTOOL, Le Bourget du Lac (FR)

( * ) Notice: Subject to any disclaimer, the term of this patent is extended or adjusted under 35 U.S.C. 154(b) by 174 days.

(21) Appl. No.: 16/094,597

(22) PCT Filed: Apr. 26, 2017

(86) PCT No.: PCT/EP2017/059998

§ 371 (c)(1),
(2) Date: Jan. 8, 2019

(87) PCT Pub. No.: WO2017/186824

PCT Pub. Date: Nov. 2, 2017

(65) Prior Publication Data

US 2019/0118250 A1 Apr. 25, 2019

(30) Foreign Application Priority Data

Apr. 26, 2016 (FR) ..... 16 70196

(51) Int. Cl.

| | |
|---|---|
| ***B22D 17/22*** | (2006.01) |
| ***B22D 17/00*** | (2006.01) |
| ***B22D 21/00*** | (2006.01) |
| ***B22C 9/06*** | (2006.01) |

(52) U.S. Cl.

CPC ..... *B22D 17/2218* (2013.01); *B22C 9/061* (2013.01); *B22C 9/065* (2013.01); *B22D 17/007* (2013.01); *B22D 17/2209* (2013.01); *B22D 21/007* (2013.01)

(58) Field of Classification Search

CPC ..... B22C 9/06; B22C 9/061; B22C 9/065; B22D 17/00; B22D 17/007; B22D 17/22; B22D 17/2209; B22D 17/2218; B22D 21/00; B22D 21/007

USPC ..... 164/72, 122, 493

See application file for complete search history.

(56) References Cited

U.S. PATENT DOCUMENTS

| | | | |
|---|---|---|---|
| 2015/0151471 A1 | 6/2015 | Feigenblum et al. | |
| 2016/0101460 A1 | 4/2016 | Suzuki | |
| 2016/0101551 A1 | 4/2016 | Guichard et al. | |

FOREIGN PATENT DOCUMENTS

| | | | |
|---|---|---|---|
| WO | WO 94/26444 A1 * | 11/1994 | ..... B22D 11/14 |
| WO | 2013/189907 A1 | 12/2013 | |

* cited by examiner

*Primary Examiner* — Kevin P Kerns

(74) *Attorney, Agent, or Firm* — IM IP Law; Chai Im; C. Andrew Im

(57) ABSTRACT

A method for die casting a metal alloy in a cavity, implementing a mold comprising an induction heater to heat the molding surfaces of the cavity. The cavity is filled with the metal alloy by injection and preheated to a nominal preheating temperature T1. The metal in the cavity is solidified. The mold is opened and the part is ejected therefrom. The molding surfaces of the cavity are heated by induction while the part is no longer in contact with said surfaces. The molding surfaces of the cavity are sprayed, the mold being opened, by a release agent. The mold is closed and the cavity is heated the temperature T1.

11 Claims, 3 Drawing Sheets

METHOD AND DEVICE FOR CASTING A METAL ALLOY

RELATED APPLICATIONS

This application is a § 371 application from PCT/EP2017/059998 filed Apr. 26, 2017, which claims priority from French Patent Application No. 16 70196 filed Apr. 26, 2016, each of which is herein incorporated by reference in its entirety.

FIELD OF THE INVENTION

The invention relates to a method and a device for pressure die casting a metal alloy. The invention is more particularly, but not exclusively, dedicated to the field of liquid phase casting or thixocasting a light magnesium or aluminium alloy. Thixocasting consists in pressure casting the metal in a semi-solid state i.e. at a casting temperature at which the liquid and solid phases coexist.

BACKGROUND OF THE INVENTION

Pressure die casting a metal alloy makes it possible to obtain a finished part directly at casting and is used in very large series to manufacture many parts that are part of mass consumption products such as supports or casings, in particular smart phones, computer tablets, cameras, but also parts subjected to high stress, in particular in the automobile industry, such as fuel injection rails, or hydraulic distributors without being limited to these examples. Typically, the parts coming from this method have a complex form, combining zones of highly variable thickness and comprising zones of low thickness. These parts must be produced in compliance with strict constraints in terms of aspect and precision, while still maintaining production speeds that are compatible with mass production. According to this method, the material forming the future part is brought to a suitable temperature, then is injected under pressure into the cavity of a mould that is resistant to the casting temperature and that comprises two metal dies, or more. The mould is preheated to a temperature less than the temperature of the injected material, in such a way that said material cools in contact with the walls of the mould. The part is cooled in the mould to a release temperature, temperature at which the mould is opened and the part, solidified, is ejected from the mould. Before producing another part, the mould being opened, the surfaces forming the cavity of said mould are sprayed with a release product, generally an aqueous product, which ensures the absence of catching or sticking of the future cast part on the walls of the mould. The mould is then closed and the cycle restarts. By way of an example of implementation, the metal is injected at a temperature between 550° C. and 650° C. according to the grade of the material and the type of casting: liquid phase or thixocasting, while the mould is preheated to a temperature of 300° C. FIG. 1, relative to the prior art shows, in FIG. 1A, an example of a thermal cycle corresponding to the method described hereinabove, showing the change in the temperature (102) on the surface of the cavity of a mould as a function of time (101), change obtained by installing a temperature probe on one of the surfaces delimiting the cavity of the mould, or by means of an infrared thermography of said surface, said mould being formed from tool steel of the DIN 1.2343 type (AISI H11, EN X38CrMoV5-1) and being intended for the casting of a thin magnesium alloy part, with the projected surface of the imprint being 200×300 $mm^2$. According to this prior art, the mould is preheated by means of a circulation of oil in conduits made for this purpose in the mould. During the step (110) of casting, the metal is injected into the mould. Said mould is preheated to a nominal preheating temperature (105), frequently about ⅓ to ½ of the casting temperature expressed in ° C., in such a way that said metal solidifies in contact with the walls of the mould. During a step of (120) releasing, the mould is opened, then the part is extracted from the mould during a step of (130) ejection. During these steps, the temperature of the cavity is maintained close to the preheating temperature. During a step (140) of spraying, a release agent is sprayed onto the surfaces of the moulding cavity. The mould is then closed and the means for regulating the temperature of the latter are implemented during a step of heating (150) in order to bring the latter to the nominal preheating temperature (105), this step of heating continues until the restarting of the cycle. The step of spraying (140) substantially reduces the temperature of the surfaces of the moulding cavity, in such a way that the conventional means of heating the mould, in particular via the circulation of oil, do not make it possible to reach the suitable nominal preheating temperature (105), while still complying with the production speeds sought.

Indeed, in the case of heating via the circulation of oil, the thermal energy transmitted by the oil to the mould is according to the difference in temperature between the mould and the oil, in such a way that the closer the temperature of the mould comes to the temperature of the oil the less effective this transfer is. The oil circulating at a temperature slightly greater than or equal to the nominal preheating temperature, the time for reaching this new temperature is conditioned by the heat exchanges between the oil and the mould, which take places over durations that are not compatible with the speeds sought.

Thus, in FIG. 1B, the temperature reached on the surfaces of the moulding cavity after the step of preheating, decreases from cycle to cycle. By way of example, for a temperature of the oil in circulation of 250° C., and a sought nominal preheating temperature of 230° C., the effective preheating temperature (106) during the 10th cycle is only 195° C. and 185° C. during the 14th cycle (107). By way of example, the duration of the cycle is about one minute, the duration of the ejection step (130) is about 8 seconds and the duration of the step (140) of spraying and of closing the mould is about 10 seconds. As these durations vary according to the cast material, the volume and the complexity of the part as well as the means implemented. The speeds that correspond to theses times do not allow for the rising of the temperature of the mould via heat exchange with the oil in circulation. Indeed, the rise in the preheating temperature sought, in the allotted timeframe, implies a thermal transfer power of several tens of KW, which cannot be achieved via an exchange with oil in circulation, more particularly when the difference in temperature between the heating oil and the mould is reduced. It is also not possible to achieve the dissipation of such heating power over the moulding surfaces via a conductive exchange with heating resistances.

Thus, according to these same measurements, the maximum heating speed of the moulding surfaces during the step (150) decreases as the difference in the temperature between the oil and the mould decreases, to descend to speeds of about a few degrees per minute over the last tens of degrees of preheating.

As the temperature of the moulding surfaces of the cavity is cooler, the metal cools faster in contact with the latter and loses fluidity more quickly which results in quality defects of the part produced, in particular aspect defects or missing material, more particularly in the zones of low thickness.

Document US 2016/101460 discloses a casting method comprising a step of spraying by a release agent of the moulding surfaces of a cavity delimited by the two portions of a mould. During the step of spraying, in order to prevent thermal shocks on the moulding surface and the risks of cracking, due to the high cooling speed imposed by the spraying of the release agent, this document recommends a pre-cooling of said surfaces using the circulation of a fluid in the mould.

Document US2016/101551 describes a mould with autonomous heating and cooling, the heating being carried out via induction by means of field windings extending into hoses made in the mould. This document does not describe operations of spraying moulding surfaces, or operations of controlling the cooling of these surfaces during the spraying thereof.

OBJECT AND SUMMARY OF THE INVENTION

The invention aims to overcome the insufficiencies of prior art and for this purpose relates to a method for die casting a metal in a cavity, implementing a mould comprising:

a. two matrices each comprising a unit carrying a moulding surface, in such a way that said moulding surfaces delimit a moulding cavity;

b. in at least one of the dies, a field winding moving in a hose made in the unit carrying the moulding surface;

c. a generator for supplying via a high-frequency current said field winding in such a way as to heat the walls of the hose (340);

d. the field winding being placed at a distance d from the moulding surface in such a way that the conduction of heat from the wall of the hose comprising the field winding to the moulding surface, through the thickness of said unit, leads to a uniform distribution of the temperature over the moulding surface.

The method comprising the steps of:

i. filling a moulding cavity by injection of the metal into said cavity, said cavity being preheated to a nominal preheating temperature T1 via the circulation of a high-frequency electrical current in the field winding;

ii. solidifying the metal in the moulding cavity;

iii. opening the mould and ejecting the part;

v. spraying the moulding surfaces of the moulding cavity, the mould being opened, by a release agent;

vi. closing the mould and heating the cavity to the temperature T1.

The method comprises after the step iii) of opening the mould and before the step v) of spraying moulding surfaces, a step of:

iv. heating by induction the moulding surfaces of the cavity while the part is no longer in contact with said surfaces, and continuing this heating during the step v) of spraying.

Thus, the combination of the means of heating via induction and the anticipated triggering of this heating before and during the spraying make it possible to offset at least partially the loss in temperature linked to the spraying of the surfaces of the cavity. Contrary to the means of prior art of heating which require heating the mould in its mass, the heating via induction concentrates its effects on the moulding surfaces and thus makes it possible to uniformly heat these surfaces in a very short time, although the mould is open, by dispensing in said surfaces a heating power of several tens of KW, without effect on the temperature of said surfaces on the effectiveness of the heating. Thus, the time required to re-establish the preheating temperature that is suitable on the surfaces of the cavity is reduced and the initial casting conditions are retained from cycle to cycle, without interruption or drop in the speed.

The invention is advantageously implemented according to the embodiments and alternatives disclosed hereinafter, which are to be considered individually or according to any technical functional combination.

According to an embodiment of the method object of the invention, the latter comprises between the step i) and the step ii) a forced cooling of the moulding cavity. This embodiment thus makes it possible to fill the cavity at a high preheating temperature, ensuring the fluidity of the material and the uniform filling of the latter, while still controlling the cooling cycle of the material and by limiting the influence of the cooling time on the cycle time.

According to an embodiment the forced cooling is carried out by the circulation of a heat transfer fluid in a conduit made in the mould.

Advantageously, the temperature T1 is between 200° C. and 400° C., preferably between 250° C. and 300° C. These preheating temperatures, out of reach in the duration by heating systems via the circulation of oil or via electrical resistance, in the cycle times sought, are particularly suitable for implementing magnesium alloys, aluminium alloys or zinc alloys, without being limited to these examples, the high preheating temperatures also having a beneficial effect on the mechanical and metallurgical characteristics of the parts, with in particular the obtaining of finer grains or the absence of porosity.

Advantageously, the heating speed during the step vi) is greater than 2° $C.s^{-1}$ and preferably about 5° $C.s^{-1}$. The concentration of the heating action on the walls of the moulding cavity makes it possible to reach such a heating speed with a reduced consumption of energy and this independently of the surface of the mould.

Advantageously, the temperature of the moulding surfaces reached during the step iv) and before the step v) is greater than T1. This controlled overheating of the moulding surfaces while the part is no longer in contact with said surfaces, makes it possible to limit the minimum temperature reached during spraying. Thus the heating during the step v) is faster.

Advantageously, the moulding cavity being brought to a temperature between 200° C. and 400° C., the metal alloy used by the method object of the invention is a magnesium alloy of the AM20, AM50, AM60 or AZ91D type. Thus the method object of the invention allows for the casting of such materials, known to be difficult to cast in cycle time conditions that are compatible with mass production.

Advantageously, the metal alloy is an aluminium and silicon alloy comprising less than 2% of silicon, for example an alloy of the Al—Mg—Si—Mn type. This type of aluminium alloy can be anodised, has a starting solidification temperature that is higher than the conventional Al—Si foundry alloys, which results in better mechanical characteristics and increased stability in temperature, to the detriment of its casting facility. The method object of the invention allows for the implementing of such material in a manner that can be reproduced in conditions for mass production.

The method object of the invention is also suitable for ide casting zinc alloys, such as alloys of zinc, aluminum and copper, known as Zamac, pressure injection cast in a hot chamber for the production of parts in large series.

The method object of the invention is suitable for casting metal alloys, injected in the liquid phase during the step i).

It is also suitable for thixocasting these alloys, injected in the semi-solid phase during the step i).

Advantageously, the unit carrying the moulding surface is formed from a steel of the HTCS 130 type. The high thermal conductivity and thermal diffusivity of this steel allows for an adjustment in temperature of the moulding surfaces that is more reactive.

According to an alternative embodiment of the tool object of the invention, the unit carrying the moulding surface is formed from a non-ferromagnetic material, wherein the hose that comprises the field winding is lined with a layer of material with a high magnetic permeability. This embodiment is more suitable for pressure die casting materials with a high melting temperature, or that are able to chemically react with the ferrous metals at the casting temperature.

BRIEF DESCRIPTION OF THE DRAWINGS

The invention is disclosed hereinafter according to its preferred embodiments, which are in no way limiting, and in reference to FIGS. 1 to 5, wherein.

DETAILED DESCRIPTION OF THE EMBODIMENTS

Figure 1A:
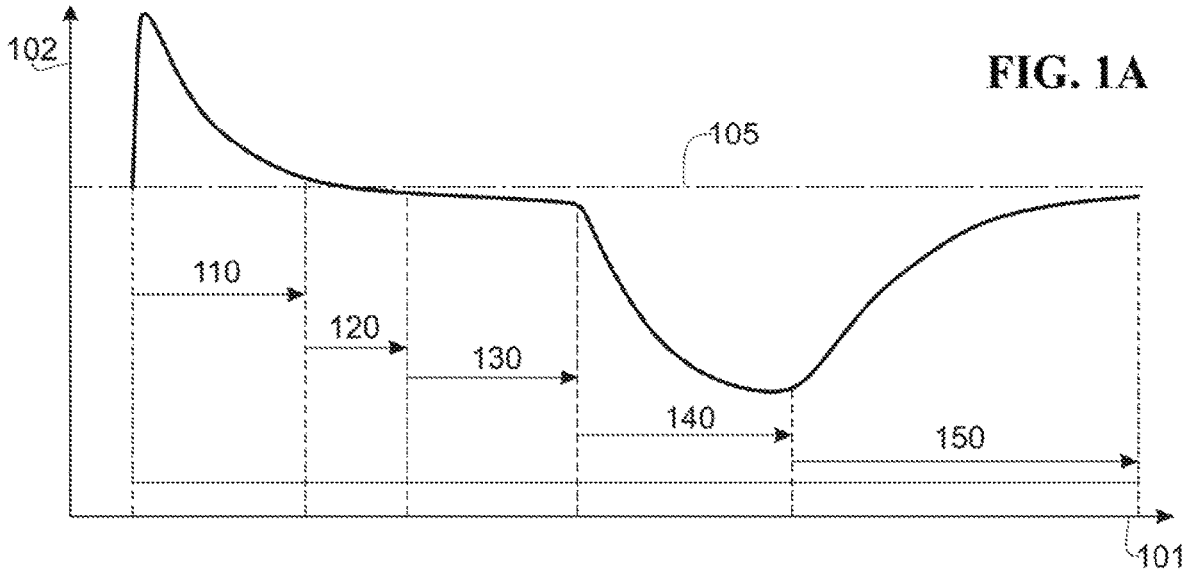
FIG. 1, relative to prior art shows, according to time-temperature diagrams, the change in the temperature of the surfaces of the moulding cavity of a pressure die casting mould preheated via a circulation of oil, FIG. 1A during a casting cycle, and FIG. 1B during a plurality of successive casting cycles.
Figure 1B:
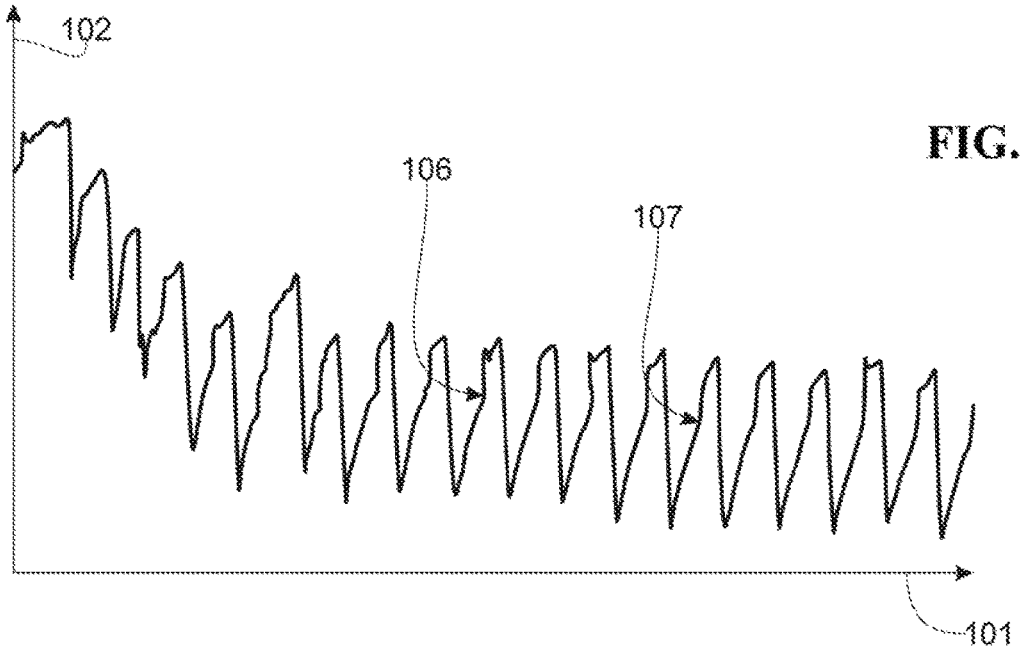
FIG. 1B (PRIOR ART)
Figure 2:
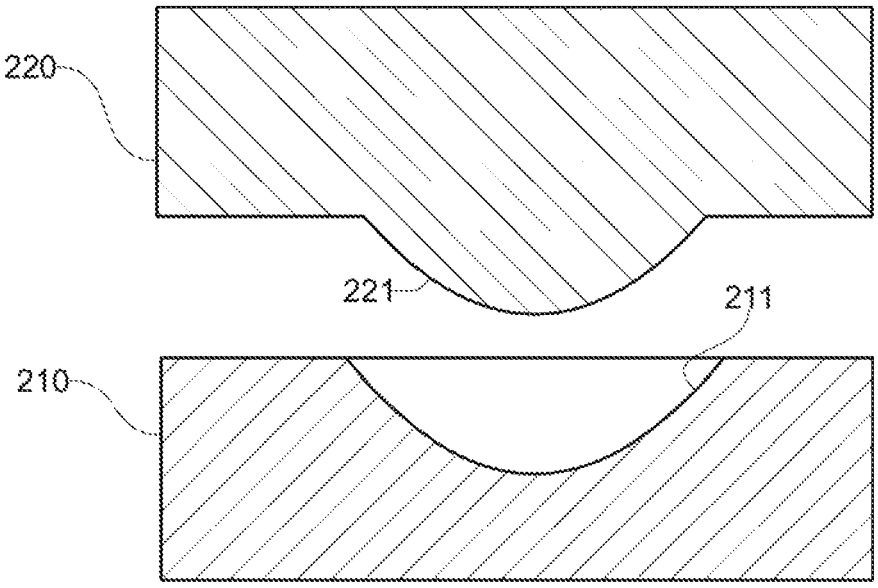
FIG. 2 is a diagrammatical view as a cross-section of the dies delimiting the moulding cavity of a tool suitable for injection casting of a metal material.

FIG. 2, according to a block diagram of the production of the tool object of the invention, the latter comprises two matrices (210, 220) and means (not shown) for bringing closer together and separating said dies from one another, in such a way as to close and open the mould. When the mould is closed, a moulding cavity is formed, cavity delimited by the moulding surfaces (211, 221) of said matrices.

Only the elements of the tool that are essential for the implementation of the invention are described here as the other characteristics of the tool are known to those skilled in the art in the field of pressure die casting. Thus, the dies of the tool object of the invention include in particular feeder conduits of the cast material into the moulding cavity of the tool as well as means for ejecting the cast part after the solidifying thereof.

Figure 3:
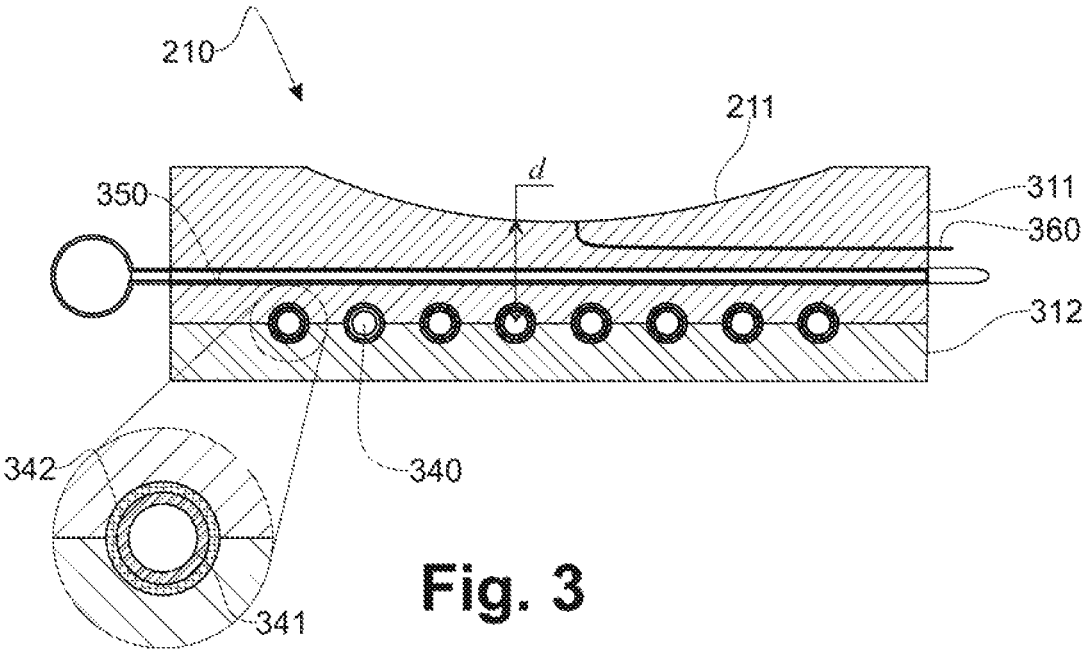
FIG. 3 shows, according to a cross-section view, an embodiment of one of the dies of a tool according to the invention suitable for the injection casting of a metal material.

In FIG. 3, according to an embodiment of the tool object of the invention, one of the dies (210), and preferably both dies, include means for heating via induction comprising a plurality of hoses (340) wherein are conveyed field windings that form an induction circuit.

Said field windings (341) are, by way of example, formed of a tube or of a copper braid, insulated from the walls of the die by a ceramic tube (342), for example a silica sheath, transparent with regards to the magnetic field generated by said field windings. The field windings with copper braids are preferred for following sinuous paths comprising low radii of curvature. The conveyance of the field windings is determined in particular via thermal simulation in order to obtain a uniform distribution of the temperature over the moulding surface, while still providing a heating time of said moulding surface that is as reduced as possible.

Advantageously, the die (210) is produced in two portions (311,312). Thus, the hoses (340) for the passage of the field windings are carried out by grooving of said portions before the assembly thereof.

One conduit or several conduits (350) for cooling are arranged in the die (210), by piercing or via grooving and assembling, as for the hoses receiving the field windings. This conduit (350) allows for the circulation, by suitable means, of a heat transfer fluid in said die in order to provide for the cooling thereof. Said heat transfer fluid circulates in said conduits at a temperature that is much less than the temperature T1 in order to ensure quick cooling. According to alternative embodiments, the heat transfer fluid circulates in the liquid phase, for example if said fluid is an oil, or in the gaseous phase, if said fluid is air or another heat -transfer gas. Advantageously the cooling circuit comprises a cooling unit (not shown) for the cooling of the heat transfer fluid to a temperature less than ambient temperature. The circulation of the heat transfer fluid makes it possible to cool the die (210) and more particularly the moulding surface (211). According to alternative embodiments, the cooling conduit (350) is placed on the same plane as the field windings and is located at an equivalent distance from the moulding surface, or the cooling conduit (350) is placed at a longer distance from the moulding surface than the field windings, the latter then being between the cooling conduit and the moulding surface, with this embodiment favouring the heating speed in relation to the cooling speed, or, the cooling conduit is positioned between the moulding surface and the field windings, this embodiment favouring the cooling speed. The circulation of the heat transfer fluid and the heating via induction can be used jointly for the purposes of regulating the temperature or the speed of cooling. A temperature sensor (360), for example a thermocouple, is advantageously placed near the moulding surface (211) in order to measure its temperature and for, where applicable, controlling the heating and cooling conditions. Using oil as a heat transfer fluid for cooling makes it possible to ensure the cooling of the mould in the implementation conditions of a pressure die casting of a light aluminium, magnesium, or zinc alloy, cooling in the gaseous phase is advantageous for higher implementation temperatures such as encountered for copper, titanium or nickel alloys.

The unit (311) of material comprising the moulding surface (211) is sufficiently thick, in such a way that the hoses (340) wherein the field windings (341) are placed are separated by a distance d from said moulding surface, so that the latter is heated, at least partially, via conduction of the heat produced by the rise in the temperature on the walls of said hoses (340), this rising in temperature being the result of the circulation of a high-frequency electrical current in the field winding (341). Thus, the distribution of temperature, resulting from the implementing of the heating via induction, is uniform over said moulding surface. The distance d is for example determined by digital simulation of the heating according to the properties of the materials that are present. Although the network of hoses (340) receiving the field windings (341) is shown here as extending in a plane, said hoses are, according to the application sought, advantageously distributed in the thickness of the unit (311) around the moulding surface.

The unit (311) carrying the moulding surface (211) is formed from a metal material in order to have a thermal conductivity and a thermal diffusivity that are sufficient for the implementing of the heating and cooling phases of the method object of the invention. Advantageously said material is ferromagnetic, for example a martensitic or ferrito-martensitic steel of which the Curie temperature is greater than or equal to the preheating temperature sought for the method of casting. By way of example, for the pressure die casting of a light alloy, the unit (311) carrying the moulding surface is formed from a steel of the DIN 1.2344 type (AISI H13, EN X40CrMoV5-1) or DIN 1.12343 (AISI H11, EN X38CrMoV5-1). Advantageously, said unit is formed from a tool steel such as described in document EP 2 236 639 and distributed commercially under the trade name HTCS 130® by the company ROVALMA SA, 08228 Terrassa, Spain. This steel has a high thermal conductivity and thermal diffusivity, which makes it possible to reduce the cycle times.

The field windings (341) are connected to a generator of high-frequency current, typically a frequency between 10 kHz and 200 kHz, by means (not shown) able to balance the resulting resonant circuit, in particular, but not exclusively, a capacitor box and an impedance adaptation coil, such as described in document WO 2013/021055. The generator of high-frequency current and the means for balancing the resonant circuit are selected in such a way as to dispense a heating power via induction of the moulding surface (211) of about 100 kW. According to alternative embodiments, according in particular to the size of the mould, the two dies forming the mould are connected to the same high-frequency generator or to two different generators.

Figure 4:
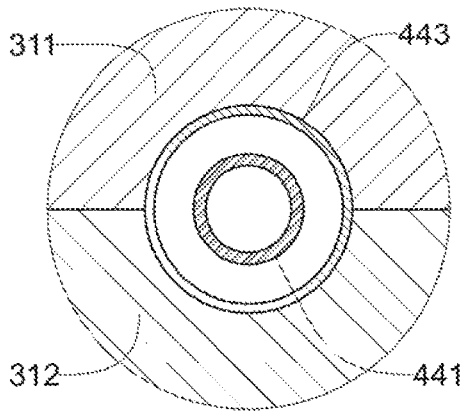
FIG. 4 shows according to a detailed view an embodiment of the installation of field windings in a die, such as shown in FIG. 3, formed from a non-ferromagnetic material.

FIG. 4, according to another embodiment, the material forming the unit (311) carrying the moulding surface of the die is not ferromagnetic. In this case, according to an embodiment, the hoses that comprise the field windings (441) are lined with a layer (443) of steel with a high magnetic permeability and that advantageously retained its ferromagnetic properties until a high temperature, for example 700° C. Thus, the magnetic field produced by the field winding (441) is concentrated in the lining (443) that quickly rises in temperature and transmits this temperature via conduction to the dies. The heat being transmitted via conduction to the moulding surface, the clever arrangement of the field windings makes it possible, as hereinabove, to ensure a uniform temperature over this moulding surface. According to embodiments of this alternative, the unit (311) carrying the moulding surface is formed from copper, an austenitic stainless steel or a nickel alloy that resists high temperatures of the INCONEL 718® type, without these examples being limiting.

When the unit (311) is formed from a ferromagnetic steel, the heating action of the field windings is distributed between a direct heating via induction of the moulding surfaces and the conduction of heat from the walls of the hoses (340) comprising the field windings. The distribution of the energy between these two heating modes is according to the distance d. When the unit (311) is formed from a non-ferromagnetic material, a similar effect is obtained by depositing, on the moulding surfaces, a ferromagnetic coating, for example a nickel coating.

Figure 5:
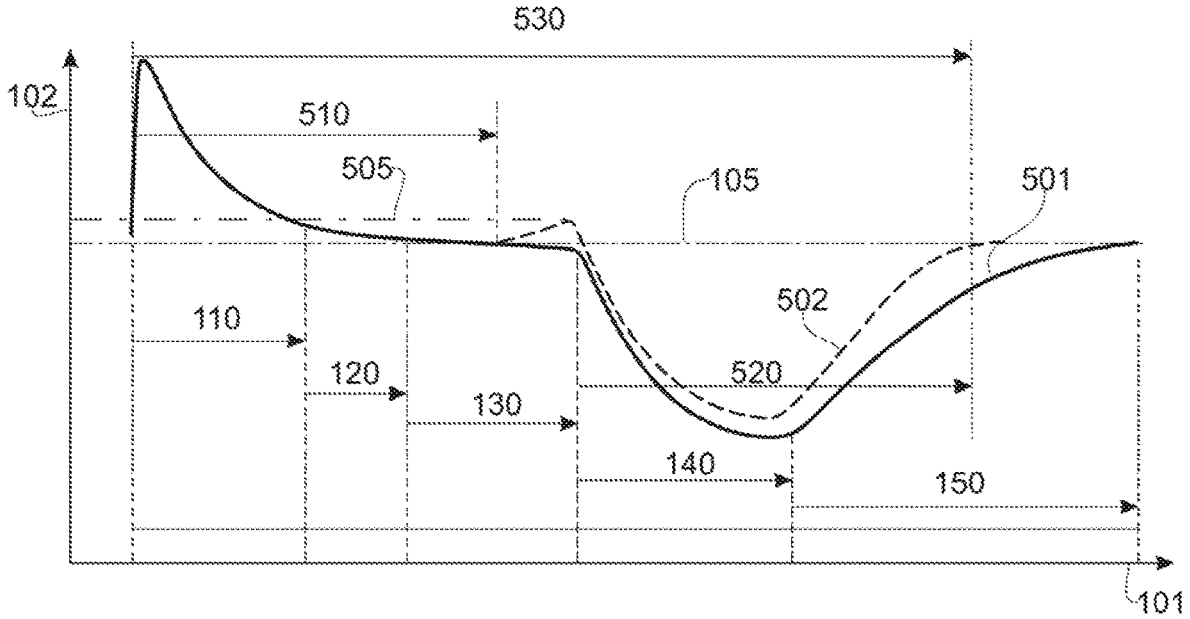
FIG. 5 shows a thermal cycle of the moulding surfaces of a pressure die casting mould by the implementing of the tool and of the method objects of the invention in comparison with the thermal cycle shown in FIG. 1A.

In FIG. 5, the comparison of the thermal cycles (501, 502) undergone by the moulding surfaces, between the thermal cycle (501) resulting from a mould with heating via the circulation of oil and the thermal cycle (502) resulting from the implementation of the tool object of the invention, shows that the duration (520) required to obtain the preheating temperature (105) from the start of the phase (140) of spraying moulding surfaces is reduced. This effect is linked to the capacity of dispensing over the moulding surfaces a heating power that is more substantial by the heating means via induction, compared to the means of prior art, and to obtain thus a faster heating speed, of about 5° $C.s^{-1}$ over said moulding surfaces, a projected surface imprint of 200×300 $mm^2$ and a heating power of about 100 kW. In addition, using heating via induction makes it possible to trigger the heating of the moulding surfaces during the step (130) of ejecting the part at a time (510) after the ejecting of the part, but before the beginning of the step (140) of spraying. This anticipating triggering of the heating via induction is carried out when the moulding surfaces are approximately at the nominal preheating temperature (105) of the moulding cavity. Said heating has for effect to bring said surfaces to a temperature (505) that is higher than said preheating temperature (105), in such a way as to limit the drop in temperature consecutive to the operation (140) of spraying. The heating power dispensed by the field windings over the moulding surfaces is sufficient to obtain this heating without slowing down the step (130) of ejecting and without delaying the step (140) of spraying. Thus, the combination of the anticipated starting of the heating, of the overheating of the moulding surface to a temperature (505) greater than the nominal preheating temperature (105), makes it possible, on the one hand, to ensure the obtaining of the preheating temperature (105) sought over the moulding surfaces, in the cycle time sought, and thus ensure the consistency of the quality of the parts produced all throughout successive cycles and thus to reduce the scrap rates. In addition, this same combination of means and of the method implemented, makes it possible to carry out the casting cycle in a time (530) that is reduced in relation to prior art, the heating power dispensed being greater and independent of the temperature of the heated surfaces, thus providing a gain in productivity at the same time as the improvement of the reliability of the method. The moulding surfaces are at a temperature close to the nominal preheating temperature (105) when the anticipated heating of said surfaces is triggered, the implementation of this measure by means of heating via the circulation of oil would be without effect, the proximity of the temperatures of the oil in circulation and of that of the mould not making it possible to carry out a thermal exchange between the oil and the material forming the mould.

The combination of the means of heating via induction and the means of cooling of the moulding surface of the tool object of the invention, makes it possible to adjust the temperature of the mould and of the load of cast material during the step (110) of casting.

Thus, the tool object of the invention makes it possible to inject the metal alloy into a hotter mould, in order to ensure better filling of the latter, while still providing cooling that is sufficiently fast of the material, in particular in order to prevent the appearance of porosities or a grain size that is not homogeneous. Contrary to prior art, where the kinematics of the casting phase (110) is dictated by the passive thermal exchanges between the mould and the material, the implementing of the tool object of the invention makes it possible to adjust, at least partially, this kinematics. Thus, the method implemented by means of the tool object of the invention makes it possible to improve the intrinsic quantity of the parts cast by this method.

The capacity of preheating the moulding surfaces to a higher temperature and of maintaining and of adjusting this temperature during the step (110) of casting, allows for the implementing of alloys of which the starting solidification temperature is higher, while still providing the filling of the moulding cavity, in particular aluminium alloys comprising less than 2% of silicon, hypoeutectic in relation to the AlSi system, by retaining production speeds that are comparable to those obtained for eutectic or quasi-eutectic alloys. Thus, the method and the tool objects of the invention facilitate the implementation of alloys with higher mechanical characteristics, in particular the Al—Si—Mg, AI-Mg—Si and Al—Mg—Si—Mn alloys, and the implementing via the casting in large series of aluminium alloys suitable for a finishing via anodising.

The effects of the method object of the invention implementing a tool comprising a heating via induction and described hereinabove are not limited to the moulding surfaces of the tool but also apply to the material feeder channels made in the die. Although the method and the tools objects of the invention are shown as applied to one of the dies, the latter can be applied to all of the dies that delimit the moulding cavity of the tool. According to embodiments, the field windings provide the heating of the moulding surfaces of said dies are connected to a single generator of high-frequency current or to generators dedicated to each die.

The description hereinabove and the embodiments, show that the invention achieves the purpose sought, and makes it possible, with regards to prior art, to increase the production speeds, to improve the repeatability of the quality of the cast parts, to improve the metallurgical quality and the production quality of said parts and to open the possibility of implementing materials with more difficult flowability in the same conditions of productivity and repeatability.

The invention claimed is:

1. A method for die casting a metal in a cavity, implementing a mold comprising:

two dies, each comprising a block carrying a molding surface, such that the molding surfaces delimit a molding cavity;

in at least one of the dies, an inductor running through a pipe arranged in the block carrying the molding surface, the inductor being configured to be powered with a high-frequency current between 10 kHz and 200 kHz to heat walls of the pipe;

the inductor being placed at a distance d from the molding surface such that conduction of heat from the walls of the pipe comprising the inductor to the molding surface, through a thickness of the block, produces a uniform distribution of a temperature over the molding surface;

the method comprising steps of:

filling the molding cavity by injecting a metal into the molding cavity, the molding cavity being preheated to a nominal preheating temperature T1 via a circulation of a the high-frequency current in the inductor;

solidifying the metal in the molding cavity;

opening the mold and ejecting a part;

spraying the molding surfaces of the molding cavity, the mold being opened, by a demolding agent;

closing the mold and heating the molding cavity to the temperature T1; and after the step of opening the mold and before the step of spraying molding surfaces, heating by induction the molding surfaces of the molding cavity while the part is no longer in contact with the molding surfaces and continuing the heating during the step of spraying.

2. The method according to claim 1, further comprising a step of forced cooling of the molding cavity between the step of filling and the step of solidifying.

3. The method according to claim 2, wherein the forced cooling is carried out by a circulation of a heat transfer fluid in a conduit in the mold.

4. The method according to claim 1, wherein the temperature T1 is between 200° C. and 400° C.

5. The method according to claim 4, wherein the temperature T1 is between 250° C. and 300° C.

6. The method according to claim 4, wherein a temperature of the molding surfaces reached during the step of spraying and before the step of closing the mold is greater than the temperature T1.

7. The method according to claim 4, wherein the metal is one of the following alloys:

a magnesium AM20, AM50, AM60 or AZ91D alloy;

an Al-Mg-Si-Mn alloy comprising less than 2% of silicon; and an aluminum, magnesium and copper zinc alloy.

8. The method according to claim 7, wherein the metal injected during the filling step is in a liquid phase.

9. The method according to claim 7, wherein the metal injected during the filling step is in a semi-solid phase.

10. The method according to claim 1, wherein the block carrying the molding surface is formed from a steel.

11. The method according to claim 1, wherein the block carrying the molding surface is formed from a non-ferromagnetic material, wherein the pipe comprising the inductor is lined with a layer of a ferromagnetic steel keeping its ferromagnetic properties up to 700° C.

* * * * *